United States Patent [19]

Altenhof, Jr. et al.

[11] Patent Number: 4,489,295

[45] Date of Patent: Dec. 18, 1984

[54] CIRCUIT INTERRUPTER WITH IMPROVED ELECTRO-MECHANICAL UNDERVOLTAGE RELEASE MECHANISM

[75] Inventors: James N. Altenhof, Jr., West Bridgewater; Jere L. McKee, Scott Township, Lawrence County; William E. Beatty, Jr., New Swickley Township, Beaver County, all of Pa.

[73] Assignee: Westinghouse Electric Corp., Pittsburgh, Pa.

[21] Appl. No.: 450,857

[22] Filed: Dec. 17, 1982

[51] Int. Cl.[3] ..... H01H 83/00

[52] U.S. Cl. ..... 335/20; 335/166; 335/176

[58] Field of Search ..... 335/20, 26, 166, 176

[56] References Cited

U.S. PATENT DOCUMENTS

| | | | |
|---|---|---|---|
| 2,280,899 | 4/1942 | Dyer et al. | 335/20 |
| 3,293,577 | 12/1966 | Kiesel et al. | 335/20 |
| 3,585,329 | 6/1971 | Maier et al. | 200/146 |
| 3,590,325 | 6/1971 | McMillen et al. | 317/31 |
| 3,775,713 | 11/1973 | Walker et al. | 335/176 |
| 3,792,380 | 2/1974 | Murotani et al. | 361/159 |

OTHER PUBLICATIONS

Westinghouse Technical Data Sheet 29-120, p. 54, dated 4/80.

Advertising Brochure for SCB-11 Systems Circuit Breaker, p. 12, dated 12/73.

*Primary Examiner*—E. A. Goldberg

*Assistant Examiner*—George Andrews

*Attorney, Agent, or Firm*—M. S. Yatsko

[57] ABSTRACT

A multiple pole circuit breaker comprises stationary and movable contacts in each pole, with a cross bar extending between the poles and causing concerted movement of the movable contacts. An operating mechanism effects movement of the movable contacts between open and closed positions, and a resettable undervoltage release mechanism cooperates with the operating mechanism to effect movement of the movable contacts. The undervoltage release mechanism operates to move the movable contacts from the closed to open position upon the occurrence of voltage levels less than a predetermined value, with the undervoltage release mechanism being reset by physical contact with the cross bar as the cross bar moves with the movable contacts from the closed to open positions.

14 Claims, 13 Drawing Figures

FIG.7.
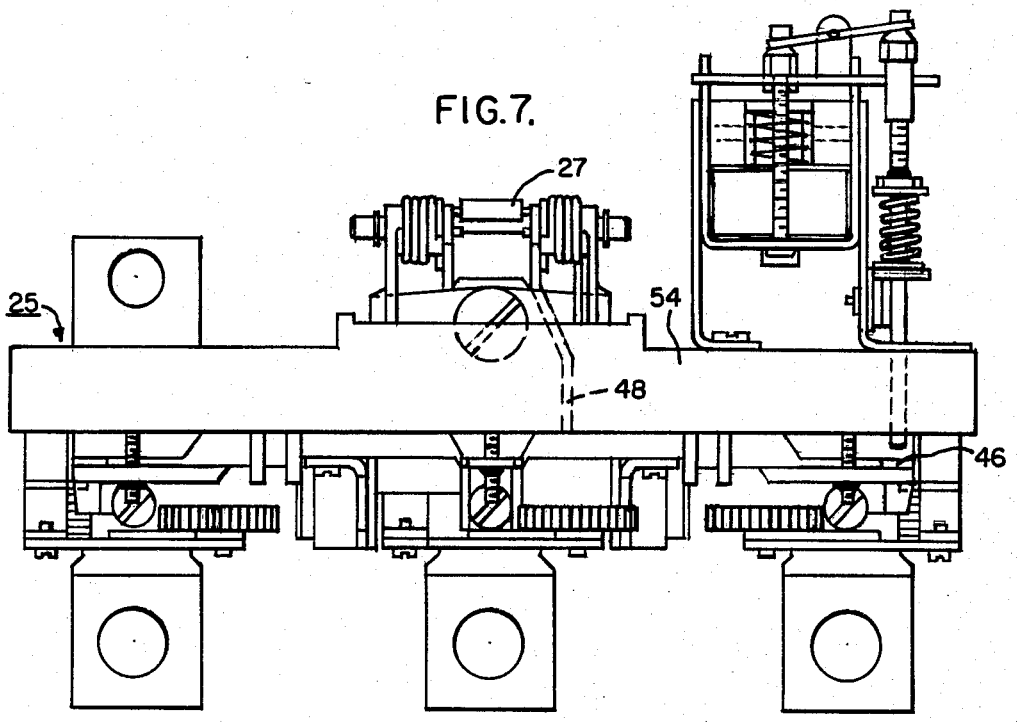
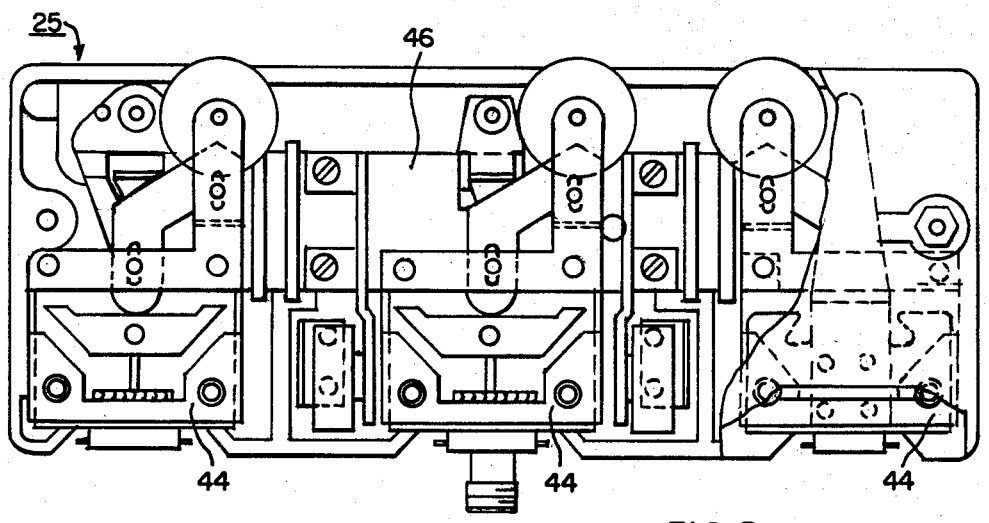
FIG.8.

CIRCUIT INTERRUPTER WITH IMPROVED ELECTRO-MECHANICAL UNDERVOLTAGE RELEASE MECHANISM

BACKGROUND OF THE INVENTION

This invention relates generally to circuit interrupters and more particularly to a multiple pole molded case circuit breaker having an improved electromechanical undervoltage release mechanism for causing tripping of the breaker whenever the line voltage falls below a predetermined level.

Molded case circuit breakers are known throughout the industry as being highly effective circuit protectors which prevent or minimize damage to low voltage electrical circuits and the electrical equipment connected thereto. The circuit breakers generally operate to interrupt the electric circuit whenever overload conditions on the line exceed predetermined safe levels. However, there is another occurrence which occasionally happens, and that involves having a line voltage less than desirable. For example, if the line voltage drops below 35 to 70 percent of normal line voltage, motors and other equipment connected to the line may attempt to run on this less than sufficient voltage, with the result being that the motors and other equipment may overheat. Therefore, it is desirable to provide undervoltage protection which will interrupt the electrical circuit whenever the voltage on the line drops below a predetermined amount.

SUMMARY OF THE INVENTION

An improved multiple pole circuit breaker is provided which comprises a stationary contact and a movable contact associated with each pole, with the movable contact operation between open and closed positions with respect to the stationary contact. A cross bar extends across all the breaker poles and is connected to the movable contacts for providing concerted movement thereof. A movement effecting mechanism which moves the movable contacts between the open and closed positions is provided, and a resettable undervoltage release means is cooperable with the movement effecting mechanism for effecting movement of the movable contacts from the closed to open position upon the occurrence of a line voltage less than a predetermined level, with the undervoltage release means being reset by physical contact with the aforementioned cross bar which moves with the movable contacts as they move from the closed to open position.

A further embodiment of the invention includes a delay means which is incorporated into the undervoltage release means which prevents the undervoltage release means from effecting movement of the movable contact from the closed to the open position unless the voltage level on the line is less than the predetermined amount for a period of time greater than a preselected duration.

BRIEF DESCRIPTION OF THE DRAWINGS

Reference is now made to the description of the preferred embodiment, illustrated in the accompanying drawings, in which:

FIG. 7 is a front sectional view of the trip device utilized in the circuit breaker for tripping the movable contact;

FIG. 8 is a bottom view illustrating the trip device utilized in the circuit breaker;

DESCRIPTION OF THE PREFERRED EMBODIMENT

Figure 1:
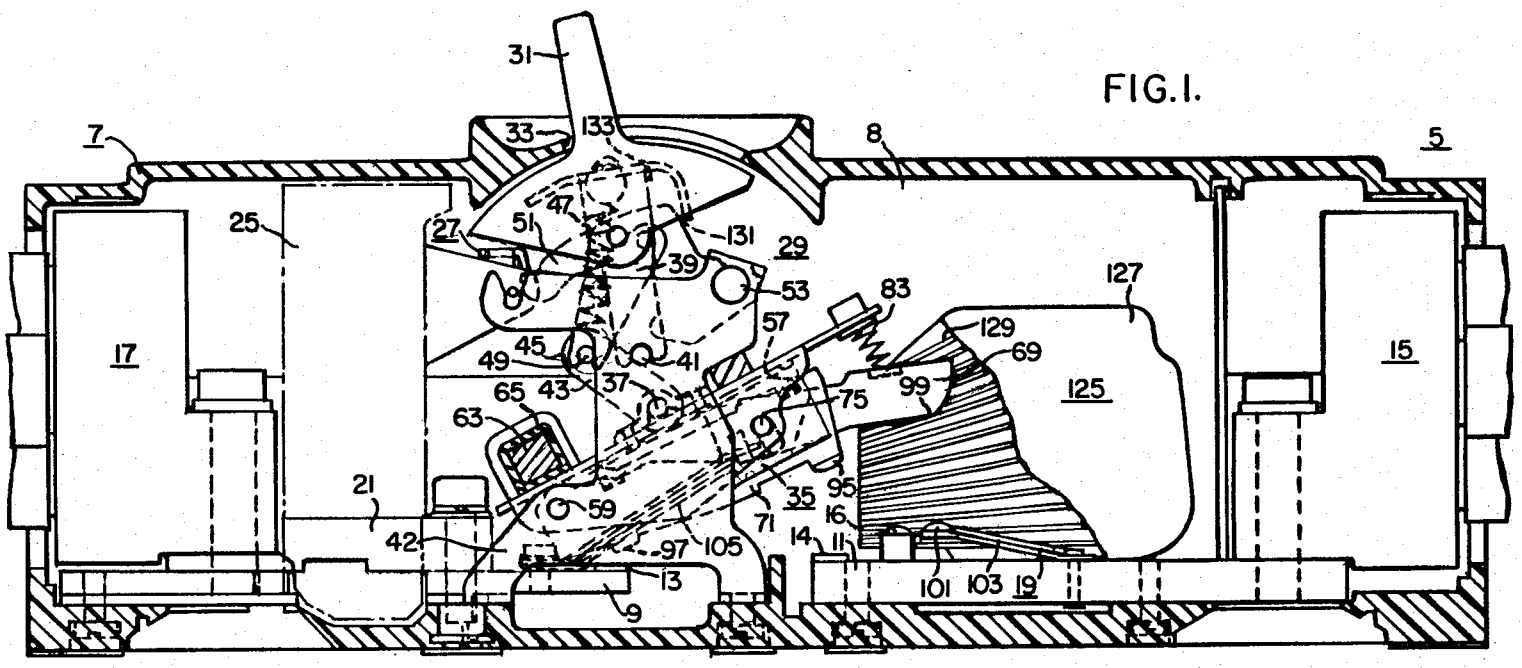
FIG. 1 is a side sectional view with parts broken away, and with parts indicated by broken lines, of a circuit breaker embodying the principal features of this invention.

Referring to the drawings, there is shown, in FIG. 1, a molded case or insulating-housing circuit breaker 5. The circuit breaker is of the type more specifically described in U.S. Pat. No. 3,585,329. Thus, only a brief description of the circuit breaker is given herein. The circuit breaker 5 comprises an insulating housing 7 having barrier means 8 separating the housing into three adjacent compartments for housing the three pole units of the multipole circuit breaker in a manner well known in the art. In each pole unit, a pair of solderless terminals 15, 17 are provided at the opposite ends of the compartment to enable connection of the circuit breaker in an electric circuit.

In each of the three pole-unit compartments there is a rigid stationary conductor 9 and a rigid stationary conductor 11, both of which conductors are fixedly secured to the housing 7. A stationary contact 13 is fixedly secured to the conductor 9, and a stationary contact 14 is rigidly secured to the conductor 11. Another stationary or fixed contact 16 is fixedly secured to the conductor 11, and an arcing contact structure indicated generally at 19 is secured to the conductor 11 for drawing and carrying arcs in a manner to be hereinafter more specifically described. A conductor 21, that is secured at one end thereof to the conductor 9 and at the other end thereof to the terminal 17, passes through an opening in a removable trip device 25. The removable trip device 25 is a thermal-magnetic trip device including a latch 27 is automatically operated to effect tripping operations of the circuit breaker in a manner well known in the art, as described in the patents to A. R. Cellerini et al., U.S. Pat. No. 3,141,081 and Walker et al., U.S. Pat. No. 3,775,713.

A single operating mechanism 29, which comprises an insulating handle 31 that extends through an opening 33 in the front of the housing 7, is connected to a movable contact structure 35 in the center pole unit by means of a pivot pin 37. The operating mechanism 29 comprises a U-shaped operating lever 39 pivotally supported on pins 41 that are supported on a frame 42. The operating mechanism 29 also comprises a pair of toggles 43, 45 and overcenter spring means 47. The spring means 47 is connected at one end to the operating lever 39 and at the other end to a knee pivot 49 that connects the toggles 43, 45. The upper toggle link 45 is pivotally connected to a trip member 51 that is pivotally supported at 53 and to the knee pivot 49 of the toggle 43, 45. The lower toggle link 43 is pivotally connected to a contact support member 57 by means of the pin 37.

The contact support member 57 is an inverted generally U-shaped rigid metallic support member that is supported for pivotal movement about a pin 59 that is supported on the supporting frame 42 in the associated pole-unit compartment. The contact support member 57 is fixedly connected to an insulating cross bar 63 by means of a metallic supporting bracket 65. The three contact support members 57 for the three pole units are all similarly connected to the common cross bar 63 for concerted operation in a manner to be hereinafter described.

The movable contact structure 35 comprises a conducting arcing-contact arm 69 and four conducting bridging main contact arms 71. The arcing-contact arm 69 is supported intermediate the bridging main contact arms 71 with two of the four bridging main contact arms 71 being supported on one side of the arcing-contact arm 69 and with the other two of the bridging contact arms 71 supported on the opposite side of the arcing-contact arm 69. The pin 59, which is supported on the associated supporting frame 42, extends through openings in the opposite legs of the U-shaped contact support member 57 to pivotally support the support member 57.

Figure 2:
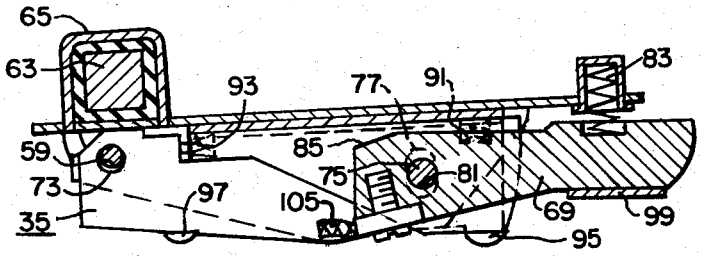
FIG. 2 is a side sectional view of one of the movable contact structures of the circuit breaker illustrated in FIG. 1.
Figure 4:
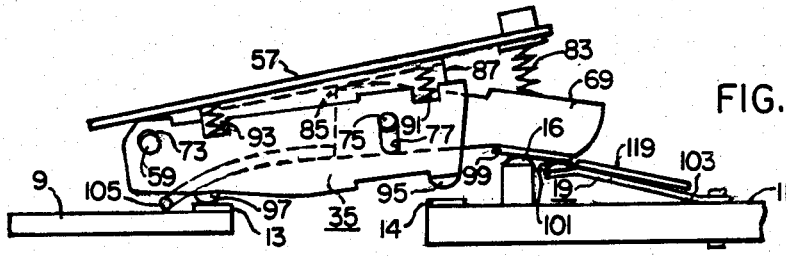
FIGS. 4, 5 and 6 are side views, with parts broken away, illustrating three different positions of one of the movable contact structures during an opening operation of the circuit breaker.

As can be seen in FIG. 2, the pin 59 also extends through openings 73 in the bridging contact arms 71. Another pin 75 extends through elongated slots 77 (FIG. 4) in the four main contact arms 71 to also provide support for the main contact arms 71. The openings 73 are larger in diameter than the pin 59 and the openings 77 are elongated in the direction shown for a purpose to be hereinafter described. The pin 75 also extends through an opening 81 (FIG. 2) in the arcing-contact arm 69 with the pin fitting snugly in the opening 81 so that the arcing-contact arm 69 is supported for pivotal movement about the axis of the pin 75. A coil spring 83 biases the arcing-contact arm 69 in a clockwise direction about the pin 75. Clockwise movement of the arcing-contact arm 69 is limited by engagement of an end portion 85 thereof with the bight portion of a U-shaped separating member 87. The U-shaped separating member 87 is a rigid metallic member that is welded or otherwise fixedly secured to the bight portion of the contact support member 57, with the opposite legs of the U-shaped member being positioned on opposite sides of the arcing-contact arm 69 spaced from the arcing-contact arm 69 in order to prevent the application of side force or side thrust from the main contact arms 71 against the arcing-contact arm 69 so that the arcing-contact arm 69 will be free to pivot on the pin 75. The force or side thrust is a result of the magnetic forces that are generated by the current which passes through the arcing-contact arm 69 and main contact arms 71 in parallel paths and that tend to squeeze the contact arms together. A separate pair of coil springs 91 and 93 is positioned between each main contact arm 71 and the bight portion of the U-shaped separating member 87 to bias the main contact arm 71 to provide contact pressure in the closed position of the contacts. Each of the main contact arms 71 is provided with a contact 95 at one end thereof for cooperating with the associated stationary contact 14 and a contact 97 in proximity to the other end thereof for cooperating with the associated stationary contact 13. The arcing-contact arm 69 is provided with a contact 99 for cooperating with the stationary or fixed contact 16 (FIG. 1) and for cooperating with an arcing contact 101 that is supported on the free end of a resilient conductor 103. The arcing-contact arm 69 is electrically connected to the rigid fixed conductor 9 by means of a flexible conductor 105.

In each pole unit, there is an arc-extinguishing structure 125 comprising an insulating casing 127 and a plurality of stacked spaced magnetic plates 129 secured in the casing 127. The plates 129, in top plan view, are generally U-shaped structures supported with the openings aligned and positioned such that the movable arcing-contact arm 69 moves within the aligned openings during opening and closing operations of the contacts. During opening of the contacts, the magnetic field around the arc, operating on the magnetic plates 129, draws the arc inward toward the bight portions of the U-shaped magnetic plates where the arc is broken into a plurality of serially related arc portions to be extinguished in a manner well known in the art.

The circuit breaker is shown in FIG. 1 in the open or "off" position with the trip member 51 in the latched position. In order to close the circuit breaker, the handle 31 is moved in a clockwise direction about the pivot 41 to operate the springs 47 to erect the toggle 43, 45 to thereby rotate the contact support member 57 of the center pole unit in a clockwise direction about the pivot 59 to the closed position seen in FIG. 3. With the three contact support members 57 being supported on the tie bar 63 for simultaneous movement, this movement operates to simultaneously move all three of the contact support members 57 to the closed position. When it is desired to manually open the circuit breaker, the handle 31 is moved in a counterclockwise direction about the pivot 41 to operate the springs 47 to cause collapse of the toggle 43, 45 to thereby move the contact support member 57 of the center pole unit to the open position seen in FIG. 1. This movement, because all the contact support members are supported for simultaneous movement on the tie bar 63, moves all three of the contact support members 57 to the open position. Each of the movable contact support members 57 moves about the associated pin 59 with all of the movable contact members moving about a common axis.

When the circuit breaker is in the closed position and an overload current above a predetermined value occurs in any of the three pole units, the trip device 25 is operated to automatically release the latch 27 to thereby release the trip member 51. As shown in FIGS. 7 and 8, whenever the thermal-magnetic overload sensors 44 sense an overload condition in any of the three pole units, the sensing units 44 cause a rotatable motion of the trip bar 46. The trip bar 46 rotates or pivots away from the trip member latch 48 (out of the paper in FIG. 8, toward the bottom in FIG. 7), thereby allowing the trip member latch 48 to slide past the trip bar 46. Once the trip member latch 48 slides past the trip bar 46, the latch 27 is permitted a pivotal movement away from the trip member 51. Upon release of the trip member 51, the springs 47 act to rotate the trip member 51 in a counterclockwise direction about the pivot 53 to cause collapse of the toggle 43, 45 and movement of the three contact support members 57 to the open position in a manner well known in the art. Upon tripping movement of the circuit breaker, the handle 31 is moved to an intermediate position to provide a visual indication that the circuit breaker has been tripped. The circuit breaker is trip free in that the breaker will trip even if the handle is manually held in the closed position.

It is necessary to reset and relatch the circuit breaker mechanism, following an automatic opening or tripping operation, before the contacts can be closed. Resetting and relatching is effected by moving the handle 31 to the extreme "off" or open position. During this movement, a shoulder 131 on the operating lever 39 engages a shoulder 133 on the trip member 51 to move the trip member 51 in a clockwise direction. At the end of this movement, the free or latching end of the trip member 51 is reengaged and relatched with the latch structure 27 in a well known manner. The circuit breaker can then be manually operated in the same manner as was hereinbefore described.

Figure 3:
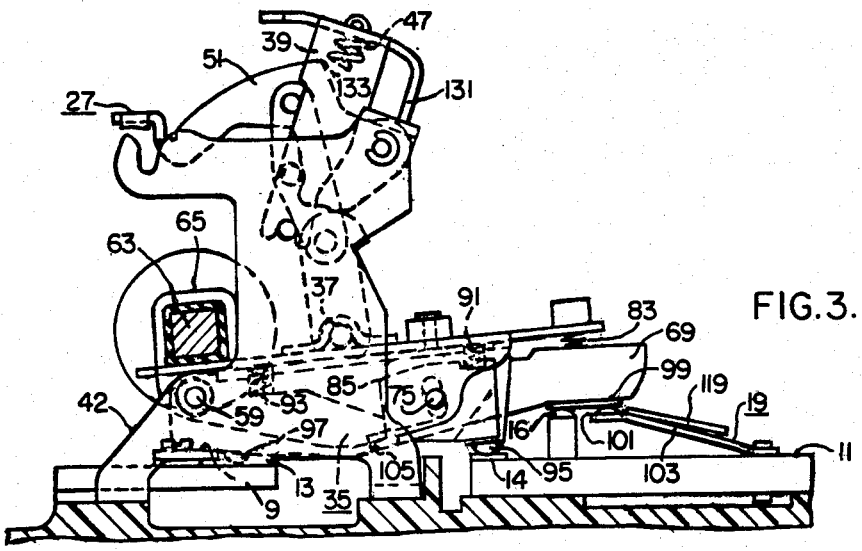
FIG. 3 is a sectional view, with parts broken away, illustrating the contact means and part of the operating mechanism from the center pole of the three pole circuit breaker illustrated in FIG. 1.

The contacts are shown in FIG. 3 in the closed position. In this position, the spring 83 biases the arcing-contact arm 69 in a clockwise direction about the pin 75 to provide contact pressure between the arcing movable contact 99 and the fixed or stationary contact 101. The resilient conductor 103 is constructed and arranged such that in the open position of the contact the arcing contact 101 is in a position higher, a limited distance, than the position shown in FIG. 3. Thus, with the arcing-contact arm 69 in the closed position seen in FIG. 3 the resilient conductor 103 is biased downward to a charged condition. Each pair of springs 91, 93 biases the associated main contact arm 71 downward to provide contact pressure between the contacts 95, 15 and between the contacts 99, 13.

In the closed position of the contacts, the circuit through each pole extends from the terminal 17 through the conductor 21, the conductor 9, the stationary contact 13, the four movable contacts 97, the four main contact arms 71, the four movable contacts 95, the stationary contacts 15, the conductor 11 to the other terminal 15.

During the opening operation of the circuit breaker, the contact support member 57 moves in a counterclockwise direction about the pivot 59. During the opening operation, the contacts first move from the position shown in FIG. 3 to the position shown in FIG. 4 in which position the contacts 95, 15 have separated before the contacts 99, 13 separate and before the contact 99 separates from the contacts 17, 101. During this initial movement, the pin 75 moves in the slots 77 from the lower end of the slots to the upper end of the slots with the springs 91, 93 biasing the main contact arms 71 downward until the pin 75 engages the upper ends of the slots whereupon the contact arms 71 move with the contact support member 57. When the contacts 95, 15 separate, the current is all carried by the contact arm 69 and flexible conductor 103 since the current flow through the main contact arms 71 is interrupted. During this movement from the FIG. 3 to the FIG. 4 position, the spring 83 biases the arcing-contact arm 69 in a clockwise direction about the pin 75 so that the arcing movable contact 99 remains in engagement with the contacts 17, 101. As the opening movement continues, the part 85 of the arcing-contact arm 69 engages the member 87 to limit clockwise movement of the arcing-contact arm 69 about the pin 75 whereupon the arcing-contact arm 69 will then move as a unit with the contact support member 57. As the parts move to the position seen in FIG. 5, the contact 101, under the bias of the charged leaf spring conducting support member 103, follows the contact 99 a limited distance to provide that the contacts 99, 17 separate before the contacts 99, 101 separate so that in the position shown in FIG. 5, the full current is carried through the contacts 99, 101. As the contacts move from the position shown in FIG. 5 to the position shown in FIG. 6, the arcing contact 99 separates from the arcing-contact 101 drawing an arc 139 that moves upward on the arcing-contact arm 69 and outward (to the right) along the arc runner 119 into the arc plates 129 where the arc is broken up by the plates 129 into a plurality of serially related arcs to be extinguished.

Figure 5:
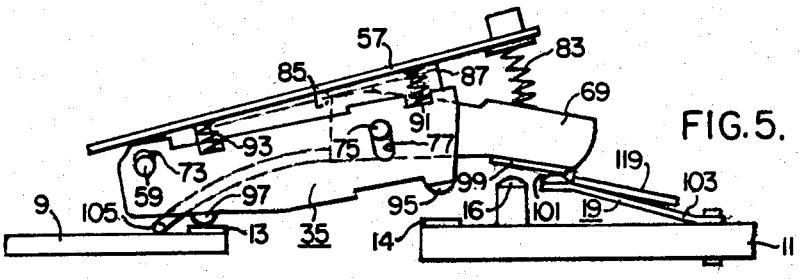
Figure 6:
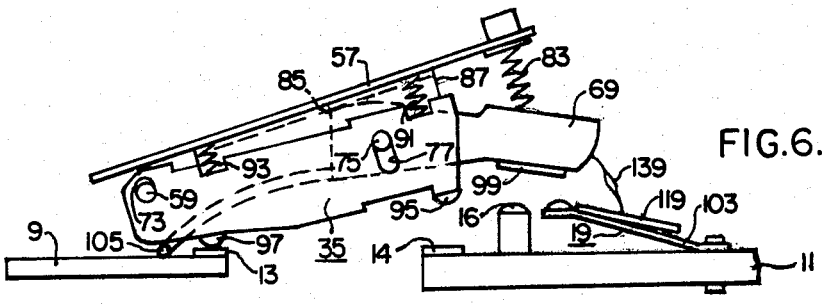

During the closing operation, the reverse sequence of contact engagement takes place as the contacts move from the FIG. 1 to the FIG. 3 position. During this movement, the contact 97 will first engage the contact 13 (FIG. 6). Then the contact 99 will engage the contact 101 as shown in FIG. 5. Thereafter, the contact 99 will engage the contact 17, and finally the contact 95 will engage the contact 15. During this movement, the arcing-contact arm 69 moves initially as a unit with the contact support member 57 until the contact 99 engages the fixed contact 17. Thereafter, the arcing-contact arm 69 will pivot counterclockwise about the pin 75 as the contact support member 57 moves to the fully closed position. When the contacts 95, 15 first engage, the pin 75 is at the upper portion of the slots 77. After the initial engagement between the contacts 95, 15 as the contact support member 73 moves to the fully closed position, the springs 91, 93 are charged and the pin 75 moves to the lower portions of the slots 77. The slots 77 are slanted relative to the direction of travel of the pin 75 so that as the slots 77 move relative to the pin 75 during the opening operation the main contact members 71 are cammed a slight distance to the right and during the closing operation the main contact members 71 are cammed a slight distance to the left to thereby provide a wiping action that serves to keep the contacts 95, 15 and 97, 13 clean.

Figure 10:
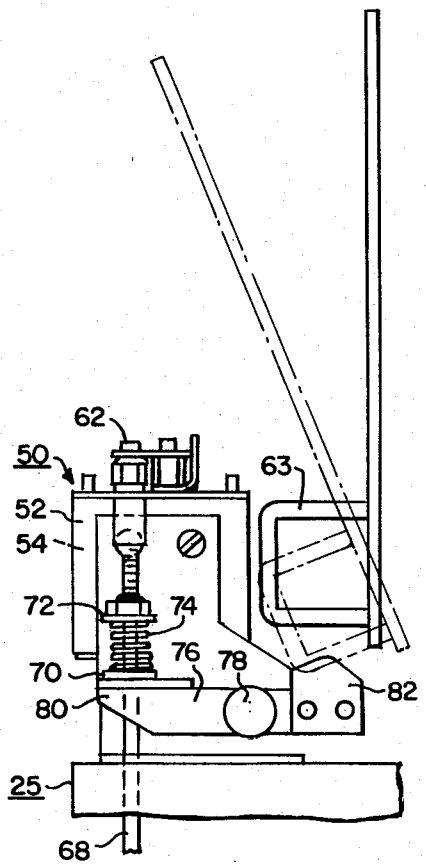
FIG. 10 is a side view showing the undervoltage release mechanism; and illustrating how the cross bar operates to reset the mechanism.

As previously described, it is desirable to provide a means for tripping the circuit breaker 5 upon the occurrence of a low voltage level in the associated line to prevent motors and other equipment from running on less than necessary voltage and thereby potentially overheating. The undervoltage release mechanism 50 illustrated in FIGS. 9 and 10 performs this function. The undervoltage release mechanism 50 is comprised of a support 52 which is secured to the insulating structure 54 (FIG. 7) which houses the trip device 25. Disposed within the support 52 is an electrical coil 54 which has leads connected to the sensing device 44, which provides power to the coil 54 at levels proportional to the voltage levels present on the conductor 21. The coil 54 has a hollow opening 56 therethrough, and extending through this opening 56 in the coil 54 is a spring-biased armature 58. The armature 58 is capable of being in two positions: a first position all the way within the coil 54, and a second position, illustrated in FIG. 9, in which the spring 24 has pushed the armature 58 outwardly of the coil 54 a predetermined distance. The armature 58 is secured to a connecting rod 60 which in turn is connected to a release pin 62. The connecting rod is pivotally secured, by means such as the pin 64, to an extension 66 of the support 52. In this fashion, movement of the armature 58 into and out of the coil 54 causes a corresponding, but oppositely directed movement of the release pin 62. The release pin 62, like the armature 58, is capable of being in two positions; a first position spaced apart from the trip bar 46, and a second position, illustrated in FIG. 9, in which the end 68 of the release pin 62 is contacting the trip bar 46 and has caused it to pivot away from the trip member latch 48.

The release pin 62 has a shoulder 70 secured thereto, and spaced apart from the shoulder 70 is a spring stop 72, with a compression spring 74 disposed therebetween. A pivotal reset lever 76, pivotal about the pin 78, has one end 80 thereof contacting said release pin shoulder 70, and has the other end 82 thereof disposed in the path of movement of the cross bar 63 as the cross bar 63 moves in conjunction with the movable contacts 95 as they move from closed to open position (movement of the cross bar being illustrated in FIG. 10 in dotted lines).

Figure 9:
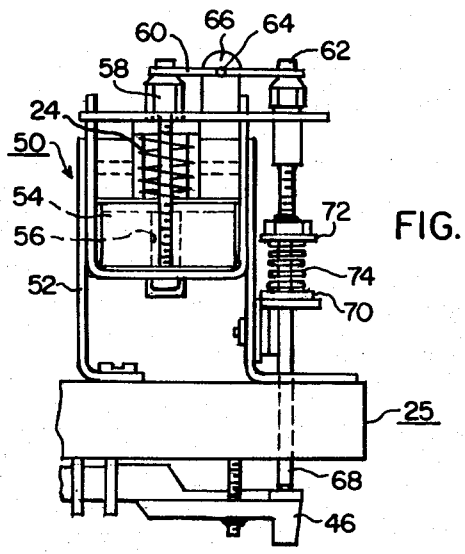
FIG. 9 is a detailed plan view illustrating the undervoltage release mechanism of this invention.

Operation of the undervoltage release mechanism 50 proceeds as follows. During an opening operation, the reset lever 76 pushes against the shoulder 70 on the release pin 62, thereby exerting a force, through the compression spring 74, against the spring stop 72 and thence the release pin 62. This force causes the release pin 62 to move to its first position away from the trip bar 46, and to the right as illustrated in FIG. 9. This movement to the right of the release pin 62 causes a corresponding movement of the armature 58, because of the pivotal action of the connecting rod 60 about the pin 64, to cause the armature 58 to move to its first position within the coil 54, or to the left as illustrated in FIG. 9. The circuit breaker 5 can then be closed once the coil 54 is energized.

During normal operation, the coil 54 has a sufficient voltage through it that it creates a magnetic field within the opening 56 and thereby holds the armature 58 in its location in a first position within the coil 54. Upon an undervoltage condition occurring within the conductor 21, the coil 54 can no longer generate a magnetic field strong enough to hold the armature 58 therein, and the armature 58 is pushed by the spring 24 to its second position outside the coil 54, as shown in FIG. 9. This movement of the armature 58 to its second position causes a corresponding movement, to the left, of the release pin 62. Movement of the second position of the release pin 62 causes the end 68 of the release pin 62 to come in contact with the trip bar 46, causing a rotation thereof, which allows the trip member latch 48 to slide underneath the trip bar 46, which correspondingly permits the latch 27 to move out of the path of the trip member 51, thereby releasing the trip member 51 and effecting opening operation of the movable contacts 95.

As the movable contacts 95 operate to go from closed to open position, the cross bar 63 which causes a concerted movement thereof likewise travels in an arcuate fashion, and comes in contact with the end 82 of the pivotal reset lever 76. As the cross bar 63 hits the reset lever 76, it forces the bottom end 82 in a downward direction, causing an upward movement of the opposite end 80 of the reset lever 76 to push against the shoulder 70 of the release pin 62. This action then, as previously described, resets the armature 58 within the coil 54 so that the circuit breaker 5 can again be closed and be prepared for another operation.

It should be noted, additionally, that the undervoltage release mechanism 50 provides an additional precaution against inadvertent operation for those heavy duty locations such as may be required for naval circuit breakers utilized upon ocean-going ships. In most locations, the circuit breaker 5 would be vertically oriented. The undervoltage release mechanism 50, as can be readily seen from the vertical orientation of FIG. 7, operates with the armature 58 in its first position not tripping the breaker being vertically lower than the armature second position where it operates to trip the breaker.

Figure 11:
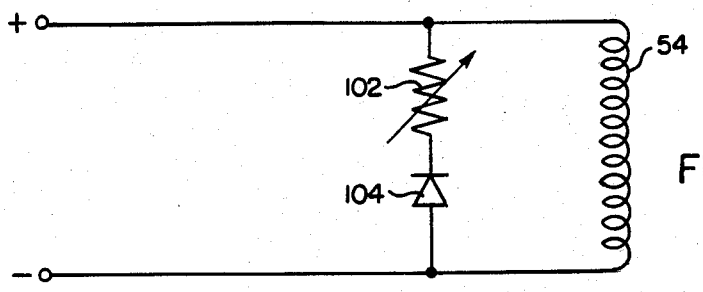
FIG. 11 is an electrical schematic illustrating a modification to the undervoltage release mechanism illustrated in FIGS. 9 and 10.
Figure 12:
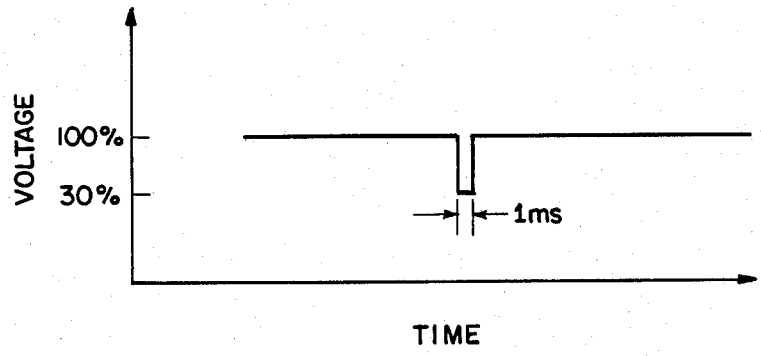
FIG. 12 is a voltage-time graph illustrating when the undervoltage release mechanism will operate.
Figure 13:
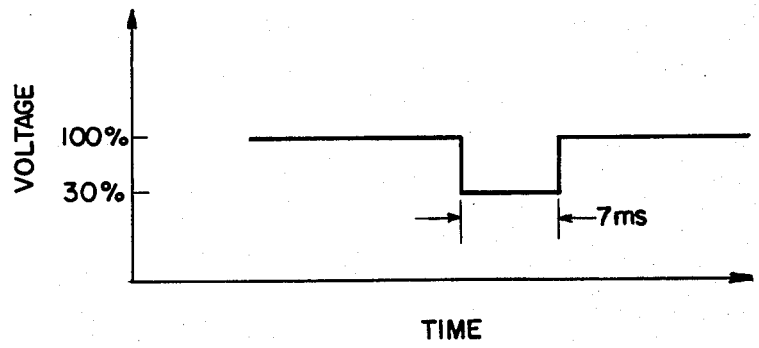
FIG. 13 is a voltage-time graph similar to FIG. 12, but illustrating how the modification shown in FIG. 11 delays operation of the undervoltage release mechanism.

Referring now more particularly to FIG. 12, there is illustrated a voltage-time graph showing how the undervoltage release mechanism 50 operates. As illustrated, normal voltage (indicated by 100%) will hold the armature 58 within the coil 54 in its first position. However, if the voltage should drop below a predetermined level (say for example 30% of normal line voltage), for a period of time as small as 1 millisecond, the coil 54 will release the armature 58 so that it can move to its second position. However, in certain installations, it is desirable that the undervoltage release mechanism 50 not operate to trip the circuit breaker 5 unless the voltage remains below the predetermined trip level for a preselected duration of time. For these particular locations, the undervoltage release mechanism 50 previously described operates too efficiently; that is, it operates faster than desired. To accommodate this desire for a slower operating device, the undervoltage release mechanism 50 can be modified as illustrated in FIG. 11. In this modification, a resistor 102 and a rectifier 104 are placed in electrical series with each other, and then the combination is placed in parallel with the coil 54. With this modification, the undervoltage release mechanism will not operate unless the voltage falls below the preselected level for a predetermined period of time. As shown in FIG. 13, using a 160 ohm resistor as the resistor 102, the undervoltage release mechanism 50 will not operate if the low voltage condition does not exceed 7 milliseconds. To provide for a variable period of time, it would be desirable that the resistor 102 be a varible resistor.

Thus, it will be appreciated that what has been described has been an improved molded case circuit breaker which incorporates an undervoltage release mechanism to trip the circuit breaker upon the occurrence of undervoltage conditions.

We claim:

1. A multiple pole circuit breaker comprising:

a stationary contact associated with each pole:

a movable contact associated with each stationary contact and operable between open and closed positions with respect thereto;

a cross bar extending across said poles and connected to said movable contacts for providing concerted movement thereof;

movement effecting means for effecting movement of said movable contacts between said open and closed positions, said movement effecting means includes a releasable trip member release of which effects operation of said movable contacts from closed to open position; and resettable undervoltage release means cooperable with said movement effecting means for effecting movement of said movable contacts from said closed position to said open position upon the occurrence of voltage levels less than a predetermined value, said undervoltage release means being reset by physical contact with said cross bar as said movable contacts move from closed to open position and comprising:

pivotable releasable latching means cooperating with said trip member for releasing said trip member;

a hollow coil electrically energized;

a reciprocably movable armature disposed within said coil and capable of being in first and second positions, said armature being biased in said second position, said coil holding said armature in said first position when said voltage level exceeds said predetermined value;

a pivotal connecting rod connected to said armature;

a reciprocating release pin secured to said connecting rod and capable of being in a first position spaced-apart from said latching means when said armature is in its first position, and a second position releasing said latching means when said armature is in its second position, said release pin having a shoulder thereon; and a pivotal reset lever having one end thereof engaging said release pin shoulder and having the other end thereof disposed in the path of movement of said cross bar when said movable contacts operate from closed to open position;

said armature first position being vertically lower than said armature second position, and said release pin first position being vertically higher than said release pin second position.

2. The circuit breaker according to claim 1 wherein said undervoltage release means includes delay means for effecting movement of said movable contact from said closed to open position only when said voltage level is less than said predetermined value for a period of time greater than a preselected duration.

3. The circuit breaker according to claim 2 wherein said delay means is adjustable to vary said preselected duration.

4. The circuit breaker according to claim 1 including a resistor serially connected with a rectifier being disposed electrically in parallel with said coil.

5. The circuit breaker according to claim 4 wherein said resistor is a variable resistor.

6. A circuit breaker comprising:

a stationary contact;

a movable contact associated with said stationary contact and operable between open and closed positions with respect thereto;

movement effecting means for effecting movement of said movable contact between said open and closed positions, said movement effecting means including a releasable trip member release of which effects operation of said movable contact from closed to open position; and resettable undervoltage release means cooperable with said movement effecting means for effecting movement of said movable contact from said closed position to said open position upon the occurrence of voltage levels less than a predetermined value, said undervoltage release means comprising:

pivotable releasable latching means cooperating with said trip member for releasing said trip member;

a hollow coil electrically energized;

a reciprocably movable armature disposed within said coil and capable of being in first and second positions, said armature being biased in said second position, said coil holding said armature in said first position when said voltage level exceeds said predetermined value;

a pivotal connecting rod connected to said armature;

a reciprocating release pin secured to said connecting rod and capable of being in a first position spaced-apart from said latching means when said armature is in its first position, and a second position releasing said latching means when said armature is in its second position; and pivotal reset lever means for resetting said undervoltage release means when said movable contact operates from closed to open position;

said armature first position being vertically lower than said armature second position, and said release pin first position being vertically higher than said release pin second position.

7. The circuit breaker according to claim 6 including a resistor serially connected with a rectifier being disposed electrically in parallel with said coil.

8. The circuit breaker according to claim 7 wherein said resistor is a variable resistor.

9. The circuit breaker according to claim 6 wherein said undervoltage release means includes delay means for effecting movement of said movable contact from said closed to open position only when said voltage level is less than said predetermined value for a period of time greater than a preselected duration.

10. The circuit breaker according to claim 1 wherein said delay means is adjustable to vary said preselected duration.

11. A circuit interrupter for protecting an electric circuit comprising cooperating contacts, an operating mechanism for opening and closing the contacts, and release means for effecting a contact opening operation of the operating mechanism upon an occurrence of a predetermined condition in said protected electrical circuit, said release means comprising a first movable structure biased toward an actuated position thereof and comprising an armature, magnetic-field producing means cooperating with said armature for magnetically holding the first movable structure normally in a first position thereof and for releasing it for movement to said actuated position when said predetermined condition occurs, a second movable structure having a first position and movable to an actuated position for effecting said contact opening operation, and connecting means interconnecting said first and second movable structures in such manner as to substantially balance said first and second movable structures with respect to one another, and to translate movement of each movable structure to either of its first and actuated positions into an oppositely directed movement of the other movable structure to its corresponding position, said release means having associated therewith resetting means operable to reset the first and second movable structures from their respective actuated positions to the first positions thereof, said cooperating contacts including movable contacts disposed on movable contact structures which are ganged for simultaneous contact-opening and contact-closing movements with each other by means of a crossbar, said resetting means being cooperable with said crossbar in such manner as to be actuated thereby during each contact-opening movement of the movable contact structures.

12. A circuit interrupter for protecting an electric circuit comprising cooperating contacts, an operating mechanism for opening and closing the contacts, and release means for effecting a contact opening operation of the operating mechanism upon an occurrence of a predetermined condition in said protected electrical circuit, said release means comprising a first movable structure biased toward an actuated position thereof and comprising an armature, magnetic-field producing means cooperating with said armature for magnetically holding the first movable structure normally in a first position thereof and for releasing it for movement to said actuated position when said predetermined condition occurs, a second movable structure having a first position and movable to an actuated position for effecting said contact opening operation, and connecting means interconnecting said first and second movable structures in such manner as to substantially balance said first and second movable structures with respect to one another, and to translate movement of each movable structure to either of its first and actuated positions into an oppositely directed movement of the other movable structure to its corresponding position, said magnetic-field producing means having associated therewith time-delay means for delaying the release of said armature for a predetermined period of time following an occurrence of said predetermined condition.

13. A circuit interrupter according to claim 12, wherein said time delay means is adjustable to vary the length of said predetermined period of time.

14. A circuit interrupter according to claim 12, wherein said magnetic-field producing means comprises an electrical coil, and said time delay means comprises a series-connection of a resistor and a rectifier diode connected across said electric coil.

* * * * *